US010630016B2

(12) United States Patent
Damodharan

(10) Patent No.: US 10,630,016 B2
(45) Date of Patent: Apr. 21, 2020

(54) CONNECTOR HOUSING ASSEMBLY HAVING AN ANTI-ROTATIONAL LOCKING STRUCTURE

(71) Applicant: Sumitomo Wiring Systems, Ltd., Yokkaichi-shi, Mie (JP)

(72) Inventor: Kasthuri Damodharan, Farmington Hills, MI (US)

(73) Assignee: Sumitomo Wiring Systems, Ltd., Yokkaichi-Mie (JP)

( * ) Notice: Subject to any disclaimer, the term of this patent is extended or adjusted under 35 U.S.C. 154(b) by 106 days.

(21) Appl. No.: 15/950,831

(22) Filed: Apr. 11, 2018

(65) Prior Publication Data

US 2019/0319390 A1 Oct. 17, 2019

(51) Int. Cl.

| | |
|---|---|
| ***H01R 13/436*** | (2006.01) |
| ***H01R 13/508*** | (2006.01) |
| ***H01R 13/64*** | (2006.01) |
| ***H01R 13/627*** | (2006.01) |
| ***H01R 13/422*** | (2006.01) |

(52) U.S. Cl.

CPC ..... *H01R 13/4365* (2013.01); *H01R 13/4223* (2013.01); *H01R 13/508* (2013.01); *H01R 13/6271* (2013.01); *H01R 13/64* (2013.01)

(58) Field of Classification Search

CPC ..... H01R 13/4365; H01R 13/4223; H01R 13/508; H01R 13/6271; H01R 13/64; H01R 13/502; H01R 13/506; H01R 1/5045; H01R 13/58; H01R 13/595; H01R 13/641; H01R 13/6275

USPC ..... 439/595, 634, 701, 465, 904, 695, 352, 439/489

See application file for complete search history.

(56) References Cited

U.S. PATENT DOCUMENTS

| | | | | |
|---|---|---|---|---|
| 5,071,369 | A | 12/1991 | Denlinger et al. | |
| 5,076,802 | A | 12/1991 | Colleran et al. | |
| 6,196,860 | B1 * | 3/2001 | Okayasu | H01R 13/506 439/395 |
| 6,773,309 | B1 | 8/2004 | Shuey | |
| 7,278,883 | B2 | 10/2007 | Tyler | |
| 8,016,606 | B1 * | 9/2011 | Kwan | H01R 13/641 439/352 |
| 8,137,142 | B1 * | 3/2012 | Dawson | H01R 13/639 439/676 |
| 2004/0248453 | A1 * | 12/2004 | McLauchlan | H01R 13/6272 439/352 |
| 2009/0035981 | A1 * | 2/2009 | Lim | H01R 13/4361 439/352 |

* cited by examiner

*Primary Examiner* — Travis S Chambers

(74) *Attorney, Agent, or Firm* — Honigman LLP

(57) ABSTRACT

A connector housing assembly having an anti-rotational locking structure for withstanding the cantilevered forces of the cable applied to a dress cover is provided. The connector housing assembly includes a connector housing and a dress cover. The anti-rotational locking structure includes a first planar edge and a second planar edge. The first planar edge is disposed above the second planar edge. The first planar edge is disposed on a side wall of the connector housing. The second planar edge is disposed on a side wall of the dress cover, wherein the second planar edge is configured to slide underneath the first planar edge so as to overcome a cantilevered force applied to the dress cover from the cable. The connector assembly may be further configured to an inadvertent locking condition.

20 Claims, 7 Drawing Sheets

CONNECTOR HOUSING ASSEMBLY HAVING AN ANTI-ROTATIONAL LOCKING STRUCTURE

TECHNICAL FIELD

The present specification generally relates to a connector housing assembly configured for housing a cable and, more specifically, to a connector housing assembly having an anti-rotational locking structure for withstanding the cantilevered forces of the cable and a support wall for preventing an inadvertent locking condition.

BACKGROUND OF THE INVENTION

Connector housing assemblies may be used to house a cable. An illustrative example of a current connector housing assembly is shown in FIG. 1. The connector housing assembly includes a connector housing. The connector housing includes a plurality of terminal cavities and a cable cavity. The cable cavity is shown generally centered within the connector housing. A lead end of the cable is positioned within the cable cavity. The remaining portion of the cable hangs from a back end of the connector housing.

The connector housing assembly further includes a dress cover. The dress cover is configured to position the cable and route the cable. The dress cover is clipped onto the back end of the connector housing. In particular, current dress covers are attached to the back end of the connector housing in a press-fit engagement wherein the sides of the dress cover are resiliently biased against respective side walls of the connector housing.

As a portion of the cable hangs freely from the back end of the connector housing, the cable may be inadvertently pulled and exert a force on the dress cover. In particular, the cable may exert a cantilevered force on a bottom portion of the dress cover. In some instances, the cantilevered force is sufficient to overcome the biased engagement between the sides of the dress cover and the side walls of the connector housing causing the dress cover to disengage from the connector housing.

Accordingly, it remains desirable to have a connector housing assembly having an anti-rotational locking structure for withstanding the cantilevered forces of the cable so as to help retain the dress cover to the connector housing.

The connector housing assembly may further include a connector positioning assurance member. The connector positioning assurance member is configured to help facilitate the engagement of the connector housing with a corresponding connector housing. For instance, a female connector housing is configured to couple with a male connector housing.

The connector positioning assurance member is movable between a pre-stage position and a locking position, wherein in the pre-stage position a back end of the connector positioning assurance member extends beyond an outer surface of the connector housing and in a locking position, the back end of the connector positioning assurance member is generally flush with the outer surface of the connector housing. However, as current designs position the back end of the connector positioning assurance member beyond the outer surface of the connector housing in a pre-stage position, the connector positioning assurance member may inadvertently be moved to the locking position upon an accidental push or drop of the connector housing.

Accordingly, it further remains desirable to have a connector housing assembly wherein the connector positioning assurance member is prevented from being inadvertently moved from a pre-stage position to a locking position.

SUMMARY OF THE INVENTION

A connector housing assembly having an anti-rotational locking structure for withstanding the cantilevered forces of the cable applied to a dress cover is provided. The connector housing assembly includes a connector housing. The connector housing includes a plurality of terminal cavities and a cable cavity. The cable cavity is shown generally centered within the connector housing.

The connector housing assembly further includes a dress cover. The dress cover includes an attachment portion and a base. The attachment portion is attached to a back end of the connector housing. The base is configured to assist with routing a cable.

The connector housing assembly further includes an anti-rotational locking structure. The anti-rotational locking structure includes a first planar edge and a second planar edge. The first planar edge is disposed above the second planar edge. The first planar edge is disposed on a side wall of the connector housing. The second planar edge is disposed on a side wall of the dress cover, wherein the second planar edge is configured to slide underneath the first planar edge so as to overcome a cantilevered force applied to the dress cover from the cable.

In one embodiment, the first planar edge is a rib disposed on the outer surface of the side wall of the connector housing. The second planar edge is disposed on a top portion of the dress cover. The connector housing includes a pair of ribs disposed on opposite side walls of the connector housing. The second planar edges are coplanar and each of the second planar edges is configured to slide underneath a respective first planar edge of the connector housing.

In one embodiment, the side wall of the connector housing includes a groove defining the first planar edge opposite a bottom planar edge. The side wall of the dress cover includes a leg protruding inwardly with respect to the side wall of the dress cover A top portion of the leg defines the second planar edge. The leg is configured to slide within the groove.

In one embodiment, the connector housing includes a locking tab disposed on one of the side walls. The dress cover includes a clip. The clip is a resilient member configured to engage the locking tab so as to secure the dress cover to the connector housing. The rib defines the first planar edge. The top portion of the clip defines the second planar edge and is configured to sit underneath the first planar edge when the clip is engaged with the locking tab.

In another aspect of the connector housing assembly, the connector housing assembly includes a support wall configured to support the connector positioning assurance member. The support wall extends beyond an outer surface of a back end of the connector housing. The support wall is rigidly fixed to the back end and extends beyond the back end a distance configured to position the connector positioning assurance member in a pre-stage position.

Accordingly, the connector housing assembly has an anti-rotational locking structure for withstanding the cantilevered forces of the cable so as to help retain the dress cover to the connector housing. The connector housing assembly is further configured to prevent the connector positioning assurance member from being inadvertently moved from the pre-stage position to the locking position.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION OF THE PREFERRED EMBODIMENTS

A connector housing assembly having an anti-rotational locking structure for withstanding the cantilevered forces of the cable applied to a dress cover is provided. The connector housing assembly includes a connector housing and a dress cover. The connector housing is configured to house a cable. A portion of the cable extends at an angle from a back end of the connector housing. The dress cover is configured to attach to the back end of the connector housing. The cable may be tied to the base so as to route the cable.

The cantilevered force may be applied by inadvertent pulling of the cable. In particular, pulling a free end of the cable as shown by arrow L1 applies a cantilevered force CF on the dress cover as shown by arrow CF depicted in FIG. 2. The anti-rotational locking structure includes a first planar edge and a second planar edge. The first planar edge is disposed above the second planar edge. The first planar edge is disposed on a side wall of the connector housing. The second planar edge is disposed on a side wall of the dress cover, wherein the second planar edge is configured to slide underneath the first planar edge so as to overcome a cantilevered force applied to the dress cover from the cable. Accordingly, the first planar edge and the second planar edge abut against each other so as to withstand the cantilevered force applied by the cable by preventing the dress cover from rotating with respect to the connector housing.

As used herein, the terms "top" and "bottom" refer to the disposition of the referenced part as depicted in the referenced figure(s). The term "back" refers to the portion of the connector housing assembly 10 to which the dress cover 14 is attached and the term "front" refers to the portion of the connector housing opposite of the "back." The term "proximal" refers to the portion of the referenced part closest to the viewer as depicted in the referenced figure, whereas the term "distal" refers to the portion of the referenced part furthest from the viewer as depicted in the referenced figure.

Figure 1:
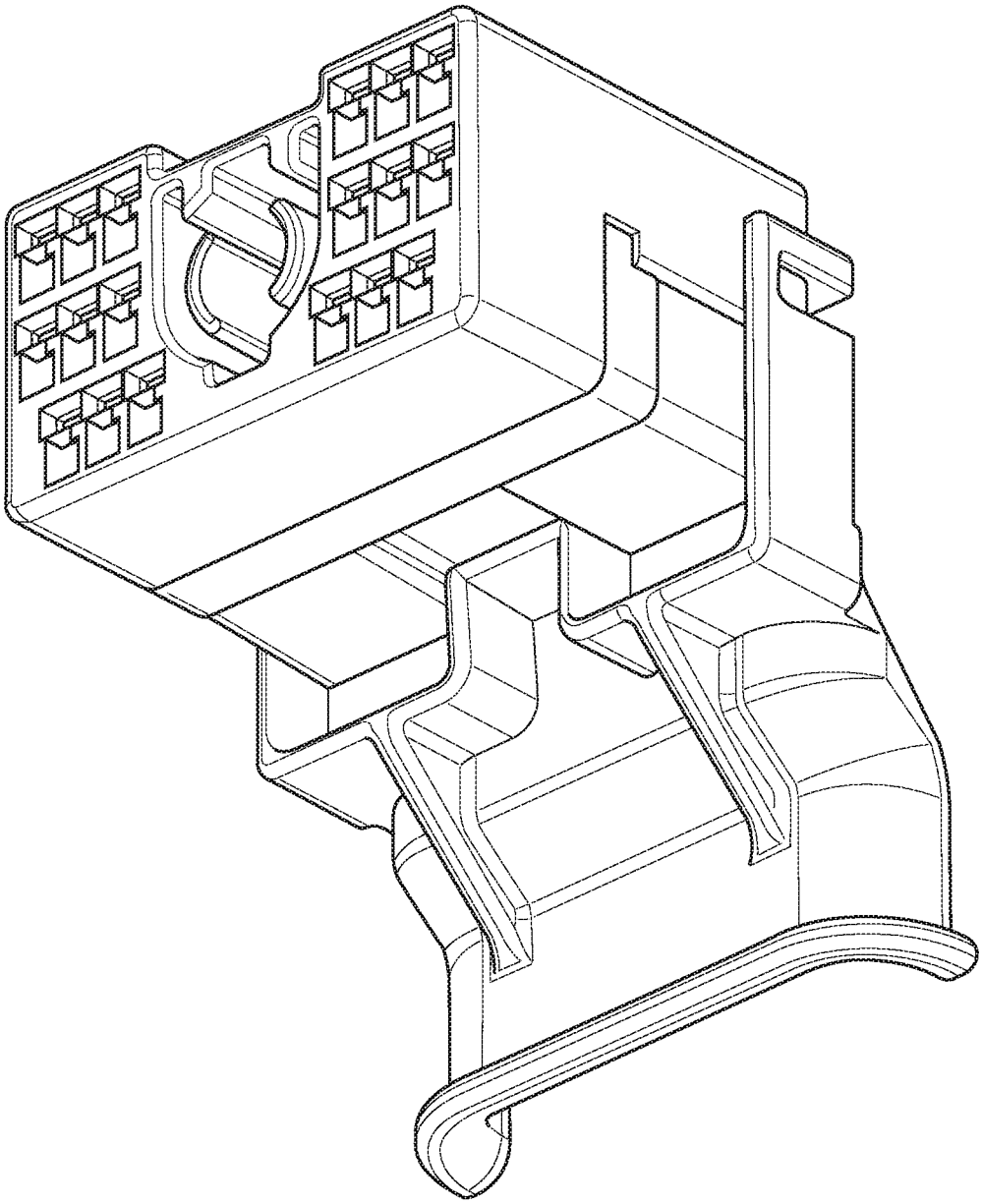
FIG. 1 PRIOR ART
FIG. 1 is a perspective view of a prior art connector housing assembly.
Figure 2:
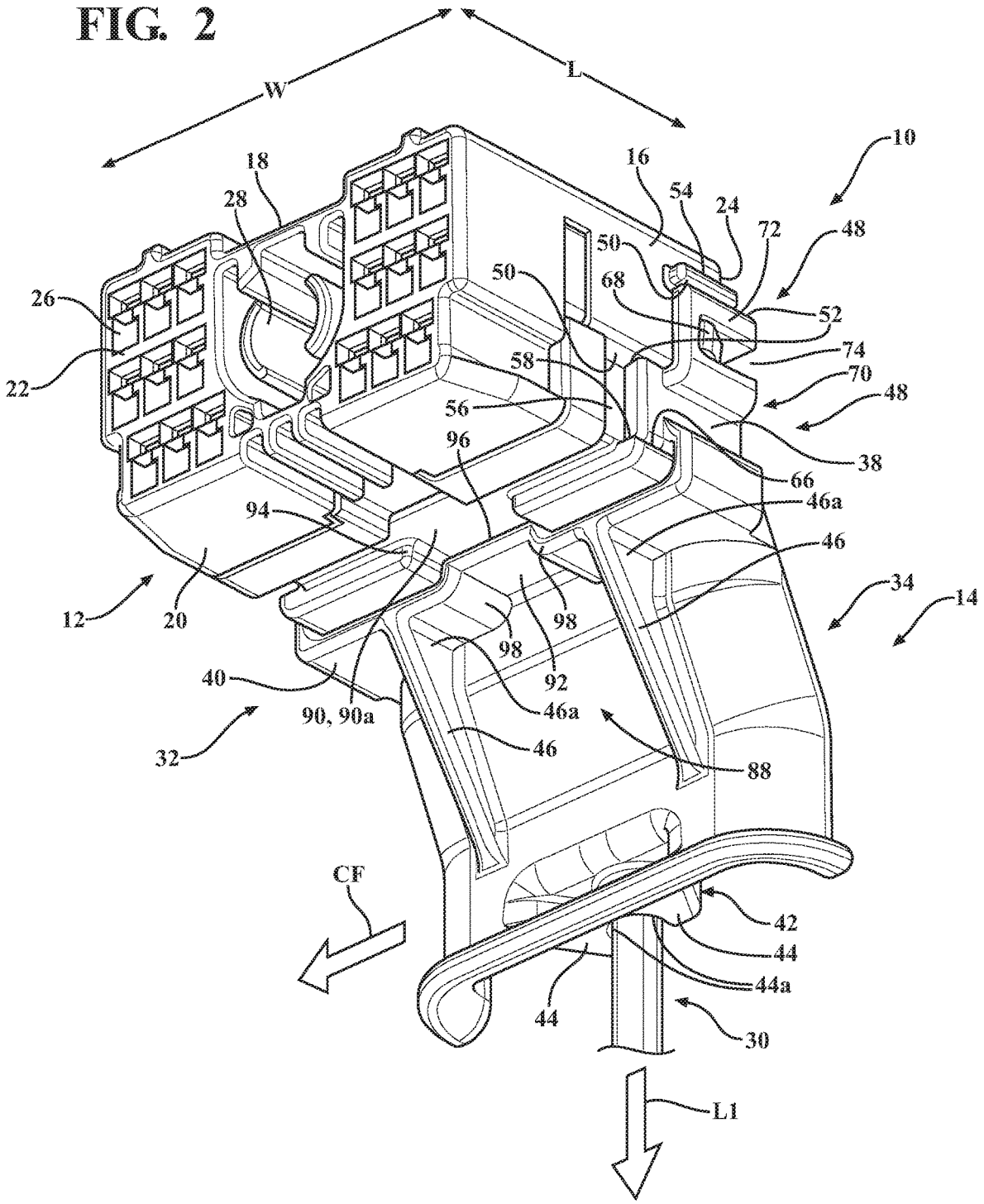
FIG. 2 is a perspective view, taken from the front, of a connector housing assembly according to one or more embodiments described and illustrated herein.

With reference now to FIG. 2 an illustrative view of connector housing assembly 10 is provided. FIG. 2 provides a depiction of connector housing assembly 10 taken from the front. Connector housing assembly 10 includes a connector housing 12 and a dress cover 14. The connector housing 12 and the dress cover 14 may be formed of a durable material adaptable for use in an injection molding process, illustratively including polypropylene.

The connector housing 12 is illustratively shown as a generally cuboidal member having a pair of first side walls 16, a top wall 18 and a bottom wall 20. The connector housing 12 includes a front end 22 opposite a back end 24. The connector housing 12 further includes a plurality of terminal cavities 26 extending longitudinally from the front end 22 to the back end 24. The connector housing 12 further includes a cable cavity 28. For illustrative purposes, the cable cavity 28 is shown generally centered within the connector housing 12. However, it should be appreciated that the cable cavity 28 may be located elsewhere. The cable cavity 28 is open to both ends of the connector housing 12 so as to receive a cable 30 from one end and allow a cable connection to be made at the other end.

Figure 3:
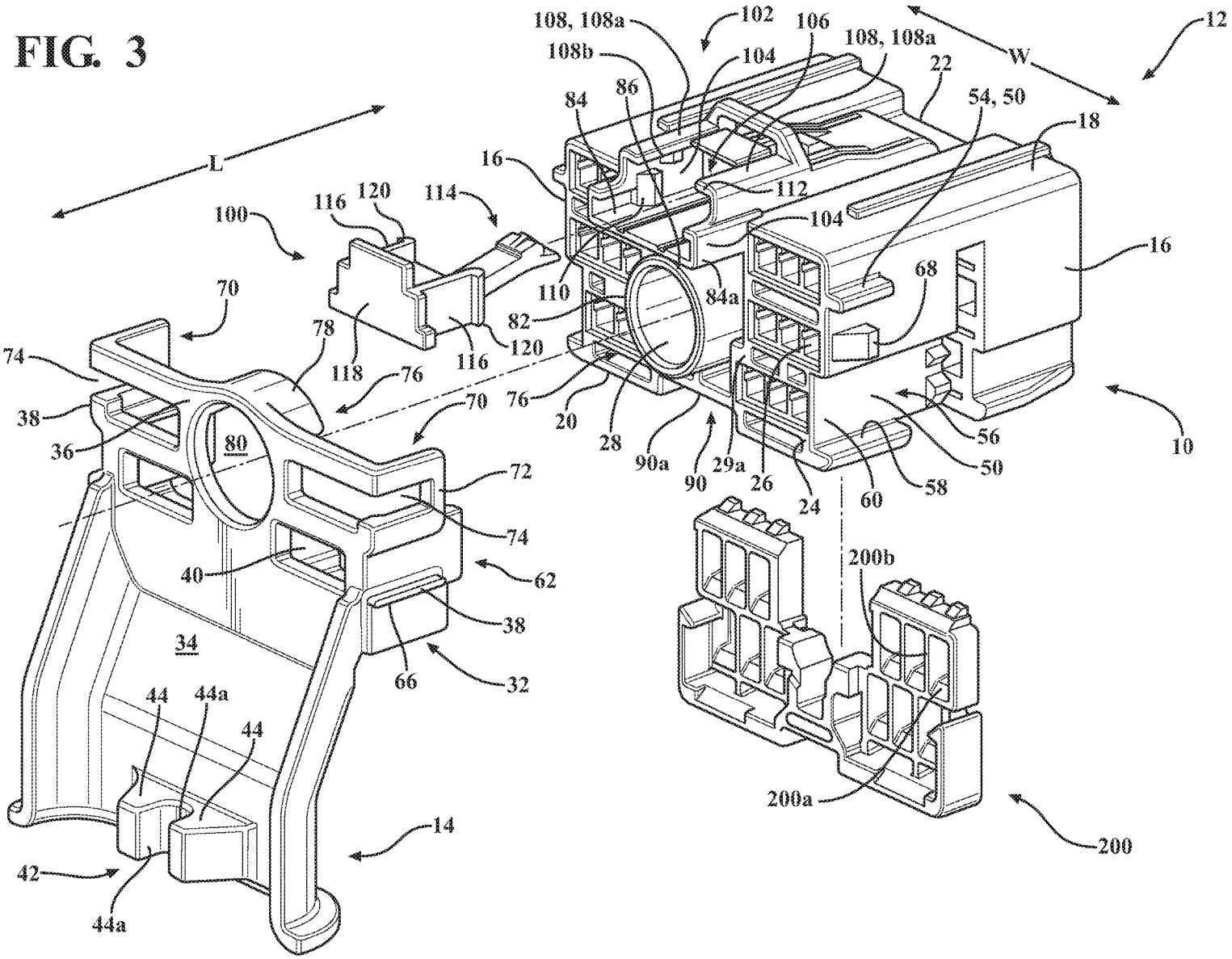
FIG. 3 is an exploded view of the connector housing assembly shown in FIG. 2, taken from the back.

With reference again to FIG. 2 and now to FIG. 3, the connector housing 12 may be further configured to accommodate a connector positioning assurance member 100 and a terminal position assurance member 200. The connector positioning assurance member 100 may be useful in facilitating a connection between the connector housing 12 and a corresponding connector housing 12. For instance, the connector housing 12 depicted in the drawings is illustratively shown as a female connector housing for housing female terminal connectors. As such, the connector positioning assurance helps facilitate a connection between the female connector housing 12 and a male connector member housing (not shown). However, it should be appreciated that the connector housing 12 may be a male connector housing as well.

The connector housing assembly 10 depicted may be used for various electrical applications and is not limiting to the scope of the appended claims. For instance, the connector housing assembly 10 depicted herein may be used for electrical signals from a camera system, wherein the signals are carried by the cable 30 having a cable diameter of 2.86 mm. It should be appreciated that the size of the cable 30 is provided for illustrative purposes and is not limiting to the scope of the appended claims. It should be further appreciated that the connector housing assembly 10 is illustratively shown as supporting a cable 30, but may be modified herein to support any other type of wire or cable, such as a coaxial cable.

The terminal position assurance member 200 includes a plurality of holes 200*a*. The holes 200*a* are defined by a plurality of slats 200*b*. The terminal positioning assurance member 200 is configured to be seated within the connector housing 12. The slats 200*b* of the terminal positioning assurance member 200 are configured to help stabilize terminal blades (not shown) so as to facilitate an electrical connection.

The dress cover 14 is configured to attach to the back end 24 of the connector housing 12. The dress cover 14 includes an attachment portion 32 and a base 34. The base 34 is configured to assist with routing a cable 30. For illustrative purposes, the base 34 is shown angled from the attachment portion 32 so as to route the cable 30 in a manner so as to have a bend in the cable 30 at approximately ninety (90) degrees.

The attachment portion 32 is configured to grip onto a back portion of the connector housing 12 so as to be seated against the back end 24 of the connector housing 12. The attachment portion 32 includes a back wall 36 and a pair of second side walls 38. The second side walls 38 are disposed on opposite sides of the back wall 36 and are generally orthogonal to the back wall 36. The second side walls 38 are spaced apart from each other so as to fittingly receive the back portion of the connector housing 12 by a resilient engagement with respective first side walls 16 of the connector housing 12.

The attachment portion 32 may further include a seat portion 40. The seat portion 40 is a generally planar member orthogonal to the back wall 36 and the second side walls 38. The seat portion 40 is configured to engage the bottom wall 20 of the connector housing 12.

The base 34 is configured to assist in routing the cable 30. The base 34 is disposed beneath the seat portion 40 of the attachment portion 32. The base 34 is angled with respect to the back wall 36 so as to route the cable 30 away from the connector housing 12. Typically, the cable 30 is secured to the base 34 by tape or a tie such as a zip tie. A hanging portion of the cable 30 is routed from the connector housing 12 at generally ninety (90) degrees and may be subject to an inadvertent pulling force. The pulling force may apply a cantilevered load/force on the dress cover 14.

In one embodiment, the base 34 may further include a gripper 42. The gripper 42 is disposed on a back surface of the base 34. The gripper 42 includes a pair of resilient arms 44 spaced apart from each other so as to hold the cable 30. In a preferred embodiment, an inner surface 44*a* of the arms is arcuate so as to accommodate the cable 30 without exerting a clamping force on the cable 30 sufficient to damage the cable 30.

Figure 4:
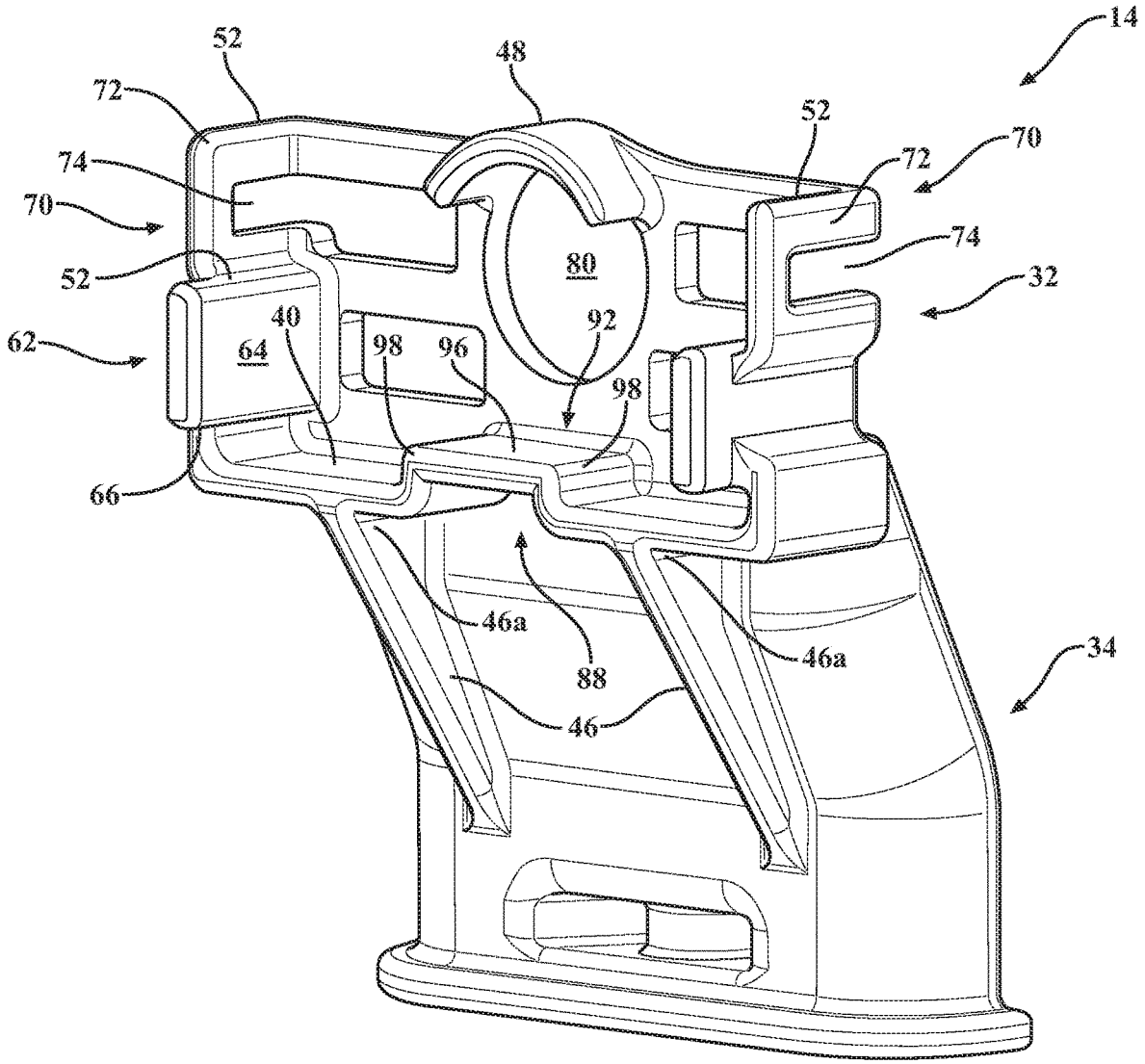
FIG. 4 is a front view of the dress cover.

With reference now to FIG. 4, a perspective view of the dress cover 14 taken from the front is provided. The dress cover 14 may further include a reinforcement rib 46. The reinforcement rib 46 may be integrally formed to the dress cover 14. The reinforcement rib 46 is configured to help maintain the structural relationship between the attachment portion 32 and the base 34. The reinforcement rib 46 is a generally planar member formed on the outer surface of a front side of the base 34. The reinforcement rib 46 includes a top portion 46*a* disposed on the outer surface of the seat portion 40

The connector housing assembly 10 further includes an anti-rotational locking structure 48 configured to withstand the cantilevered force of the cable 30 so as to retain the dress cover 14 to the connector housing 12. In particular, the anti-rotational locking structure 48 includes at least one first planar edge 50 and at least one second planar edge 52. The first planar edge 50 is disposed above the second planar edge 52. The second planar edge 52 is configured to slide underneath the first planar edge 50 so as to overcome a cantilevered force applied to the dress cover 14 from the cable 30.

The first planar edge 50 is disposed on the connector housing 12 and the second planar edge 52 is disposed on the dress cover 14. The first planar edge 50 is disposed along an axis extending the length "L" of the connector housing 12. The second planar edge 52 is disposed on the dress cover 14 and is configured to lie on an axis parallel to the first planar edge 50 and on a plane underneath the plane in which the first planar edge 50 lies.

With reference now to FIGS. 2-5, various embodiments of the anti-rotational locking structure 48 are illustratively depicted. As described above, the anti-rotational locking structure 48 includes a first planar edge 50 disposed on the connector housing 12 and a second planar edge 52 disposed on the dress cover 14 wherein the second planar edge 52 is configured to be seated underneath the first planar edge 50 when the dress cover 14 is mounted to the connector housing 12.

In one embodiment, a rib 54 is disposed on the outer surface of the first side wall 16 of the connector housing 12. The rib 54 defines the first planar edge 50. The top edge of the second side wall 38 of the attachment portion 32 of the dress cover 14 defines the second planar edge 52. FIG. 2 illustrates how the second planar edge 52 is disposed beneath the first planar edge 50 when the dress cover 14 is attached to the connector housing 12. The first planar edge 50 is an elongated member having a planar surface facing the bottom of the connector housing 12. The second planar edge 52 is an elongated member having a planar surface defining the top of the dress cover 14. The planar surfaces abut each other, thus preventing rotation of the dress cover 14 with respect to the connector housing 12. In other words, the planar surfaces withstand a cantilevered load applied to the base 34 of the dress cover 14 by the cable 30.

Figure 5:
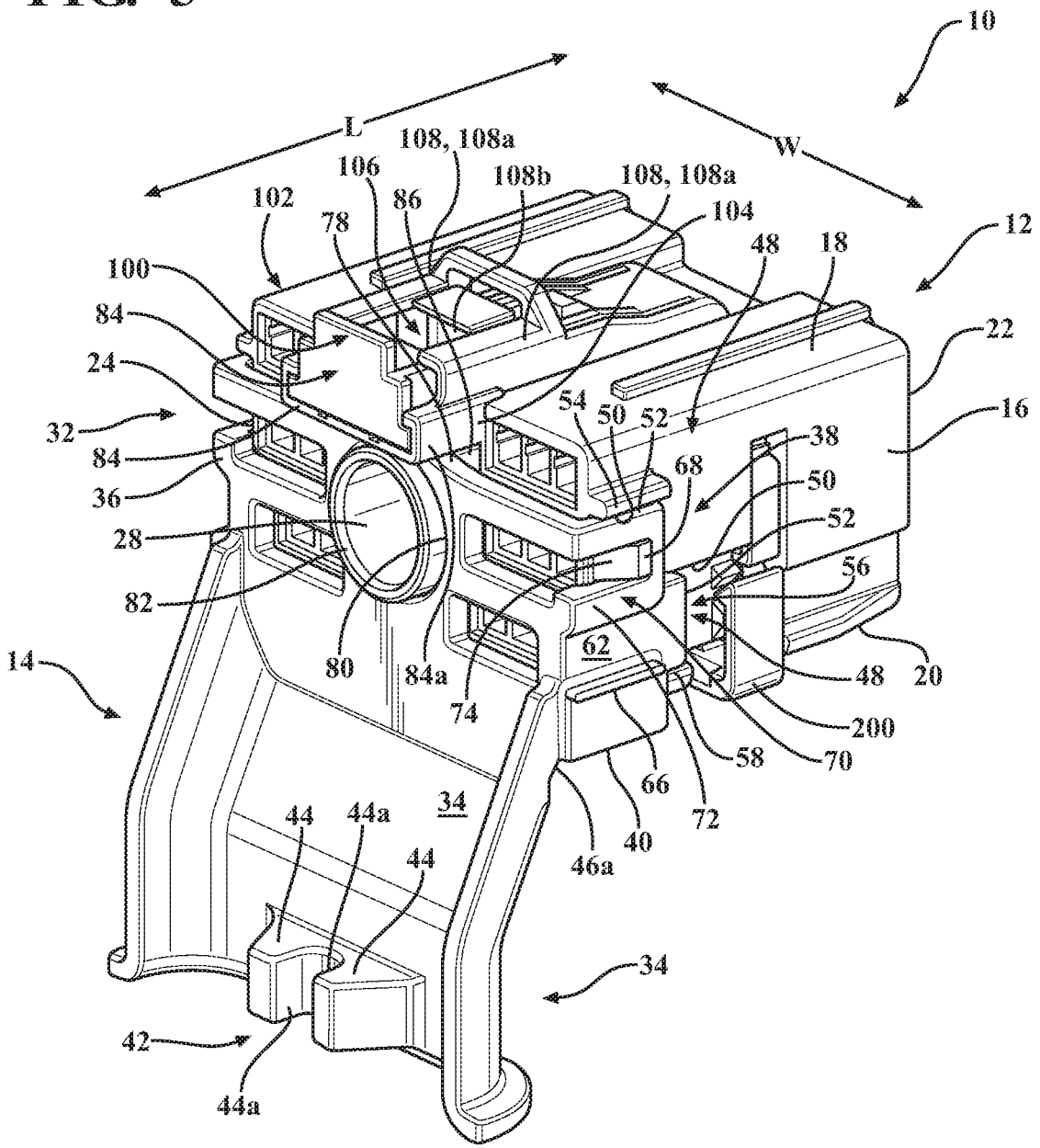
FIG. 5 is a perspective view of the back of the connector housing assembly.

In one aspect, connector housing assembly 10 includes a pair of ribs 54. Each of the ribs 54 is disposed on opposite first side walls 16 of the connector housing 12. FIG. 2 shows a rib 54 disposed on one of the first side walls 16 of the connector housing 12. FIG. 5 shows the other rib 54 disposed on the other first side wall 16 of the connector housing 12. The ribs 54 are opposite of each other and coplanar.

Likewise, the top edge of each of the second side walls 38 of the attachment portion 32 of the dress cover 14 defines the second planar edge 52. The second planar edges 52 are opposite of each other and coplanar. Thus, a load applied to the base 34 by the cable 30 in a downward direction is distributed evenly among the pair of first planar edges 50 and corresponding second planar edges 52.

With reference again to FIG. 2, in one embodiment, the first side wall 16 of the connector housing 12 includes a groove 56 defining the first planar edge 50 opposite a first bottom edge 58. The groove 56 includes a first surface 60. The first surface 60 is generally planar and is recessed with respect to the outer surface of the first side wall 16. The first planar edge 50 is spaced apart from the first bottom edge 58 a distance defined by the width of the groove 56. The first planar edge 50 is parallel to the first bottom edge 58. Both the first planar edge 50 and the first bottom edge 58 are orthogonal to the first surface 60 and the outer surface of the first side wall 16.

The second side wall 38 of the dress cover 14 includes a leg 62 protruding inwardly with respect to the outer surface of the second side wall 38 of the dress cover 14, as shown in FIG. 4. The leg 62 includes a second surface 64. The second surface 64 is generally planar and is recessed with respect to the outer surface of the second side wall 38 so as to define the second planar edge 52 and a second bottom edge 66. The second planar edge 52 is spaced apart from the second bottom edge 66 a distance defined by the width of the leg 62. The second planar edge 52 is parallel to the second bottom edge 66. Both the second planar edge 52 and the second bottom edge 66 are orthogonal to the second surface 64 and the outer surface of the second side wall 38.

As shown in FIG. 2, the second planar edge 52 of the leg 62 is disposed beneath the first planar edge 50 of the groove 56, and the second bottom edge 66 of the leg 62 is disposed above the first bottom edge 58 of the groove 56. In such a manner the, leg 62 is fixed within the groove 56 so as to withstand the cantilevered force applied by the cable 30 on the base 34 of the dress cover 14.

As shown in FIGS. 2 and 4, in one embodiment, connector housing assembly 10 includes a pair of grooves 56 and a pair of legs 62. The grooves 56 and the legs 62 are coplanar. Each of the first side walls 16 includes a groove 56, and each of the second side walls 38 includes a leg 62. The legs 62 are slid into a respective groove 56, wherein each of the second planar edges 52 of the legs 62 are disposed beneath a respective first planar edge 50 of the groove 56 and the second bottom edge 66 of the leg 62 is disposed above the first bottom edge 58 of the groove 56. In such a manner the legs 62 are fixed within a respective groove 56 so as to withstand the cantilevered force applied by the cable 30 on the base 34 of the dress cover 14. Further, the cantilevered force applied by the cable 30 is distributed generally equally between the groove 56 and legs 62 on respective sides of connector housing assembly 10.

With reference again to FIG. 2, in one embodiment, the connector housing 12 includes a locking tab 68 disposed on one of the first side walls 16. The locking tab 68 is disposed beneath the rib 54. The dress cover 14 includes a clip 70. The clip 70 is a resilient member configured to engage the locking tab 68 so as to secure the dress cover 14 to the connector housing 12.

The first planar edge 50 is the rib 54 disposed on the first side wall 16 of the connector housing 12. The second planar edge 52 is formed on a top portion of the clip 70 and is configured to sit underneath the first planar edge 50 when the clip 70 is engaged with the locking tab 68. The clip 70 is illustratively shown as having a clip body 72 with a slot 74 open to a back end 24 of the clip body 72 so as to define a generally U-shaped member. The clip 70 and locking tab 68 cooperate with each other to retain the dress cover 14 to the connector housing 12, wherein the second planar edge 52 of the top portion of the clip 70 cooperates with the rib 54 to help withstand the cantilevered force applied to the base 34 of the dress cover 14 by the cable 30.

With reference again to FIG. 2 and now to FIG. 4, connector housing assembly 10 may include a pair of clips 70 and a pair of locking tabs 68, wherein each of the first side walls 16 of the connector housing 12 includes a locking tab 68 and each of the second side walls 38 of the attachment portion 32 of the dress cover 14 includes a clip 70. The locking tabs 68 and the clips 70 are generally coplanar. In such a manner the clips 70 are engaged with a respective locking tab 68 so as to retain the second side wall 38 of the attachment portion 32 of the dress cover 14 to the connector housing 12. Additionally, each of top portion of the second side wall 38 of the attachment portion 32 are seated beneath a respective rib 54 so as to withstand the cantilevered force applied by the cable 30 on the base 34 of the dress cover 14. Further, the cantilevered force applied by the cable 30 is distributed generally equally between each top portion of the clips 70 and a respective rib 54 of the connector housing 12.

With reference now to FIGS. 3-5, connector housing assembly 10 may further include a guide feature 76. In one embodiment, the guide feature 76 is a semi annular lip 78 surrounding a top portion of a hole 80 disposed on the back wall 36 of the attachment portion 32. The hole 80 is configured to receive the cable 30. The guide feature 76 further includes the cable cavity 28 of the connector housing 12. In particular, the cable cavity 28 is defined by a cylindrical member 82. A proximal end of the cylindrical member 82 extends beyond the outer surface of the back end 24 of the connector housing 12. The connector housing 12 includes a support wall 84 configured to support the connector positioning assurance member 100. The support wall 84 is spaced apart from the cylindrical member 82 so as to form a gap 86. FIG. 5 shows how the gap 86 is sufficient to receive the annular lip 78. FIG. 5 also depicts how the proximal end of the cylindrical member 82 is dimensioned to extend beyond the outer surface of the back wall 36 when the attachment portion 32 is attached to the connector housing 12. The annular lip 78 has a radius commensurate with the cylindrical member 82 so as to be concentric to the cylindrical member 82. The annular lip 78 helps guide the attachment portion 32 onto the connector housing 12 by simply sliding the annular lip 78 over the cylindrical member 82. Further, the annular lip 78 helps overcome the cantilevered force applied to the dress cover 14 by the cable 30 by engagement with the undersurface of the support wall 84.

With reference again to FIGS. 2 and 4, connector housing assembly 10 may further include a lateral confinement structure 90 disposed on the bottom wall 20 of the connector housing 12 and the seat portion 40 of the dress cover 14. The lateral confinement structure 90 is configured to overcome a load which may pull the dress cover 14 away from the connector housing 12 in a lateral direction or along the width "W" of connector housing assembly 10. In one aspect of the lateral confinement structure 90, the bottom wall 20 of the connector housing 12 includes an under groove **90*a* and the seat portion 40 of the attachment portion 32 includes a bottom leg 92**.

The under groove **90*a* includes a first under surface 90*b*. The first under surface 90*b* is generally planar and is recessed with respect to the outer surface of the bottom wall 20 so as to define a pair of first lower walls 94. The pair of first lower walls 94 are spaced apart from each other a distance defined by the width of the under groove 90*a*. The pair of first lower walls 94 are parallel to each other. Both of the first lower walls 94 are orthogonal to the first under surface 90*b* and the outer surface of the bottom wall 20**.

The bottom leg 92 includes a second upper surface 96. The second upper surface 96 is generally planar and is elevated with respect to the outer surface of the seat portion 40 so as to define a pair of second lower walls 98. The pair of second lower walls 98 are spaced apart each other a distance defined by the width of the bottom leg 92. The pair of second lower walls 98 is parallel to each other. Both of the second lower walls 98 are orthogonal to the second upper surface 96 and the outer surface of the seat portion 40. The bottom leg 92 is seated within the under groove **90*a*, wherein the second lower walls 98 are slid against a respective first lower wall 94. As such, the first lower walls 94 and the second lower walls 98 cooperate with each other to help withstand a lateral load applied to the base 34 of the dress cover 14 so as to help retain the dress cover 14 to the connector housing 12**.

Accordingly, provided herein is a connector housing assembly 10 having an anti-rotational locking structure 48 configured to withstand a cantilevered load applied to the dress cover 14 by the cable 30. Connector housing assembly 10 may further include a guide feature 76 configured to help position the dress cover 14 onto the connector housing 12 so as to ensure the dress cover 14 is properly attached thereto. The guide feature 76 may be further configured to help withstand the cantilevered load applied to the dress cover 14 by the cable 30. Connector housing assembly 10 may further include a lateral confinement structure 90. The lateral confinement structure 90 is configured to overcome a load which may pull the dress cover 14 away from the connector housing 12 in a direction along the width "W" of connector housing assembly 10.

Figure 6:
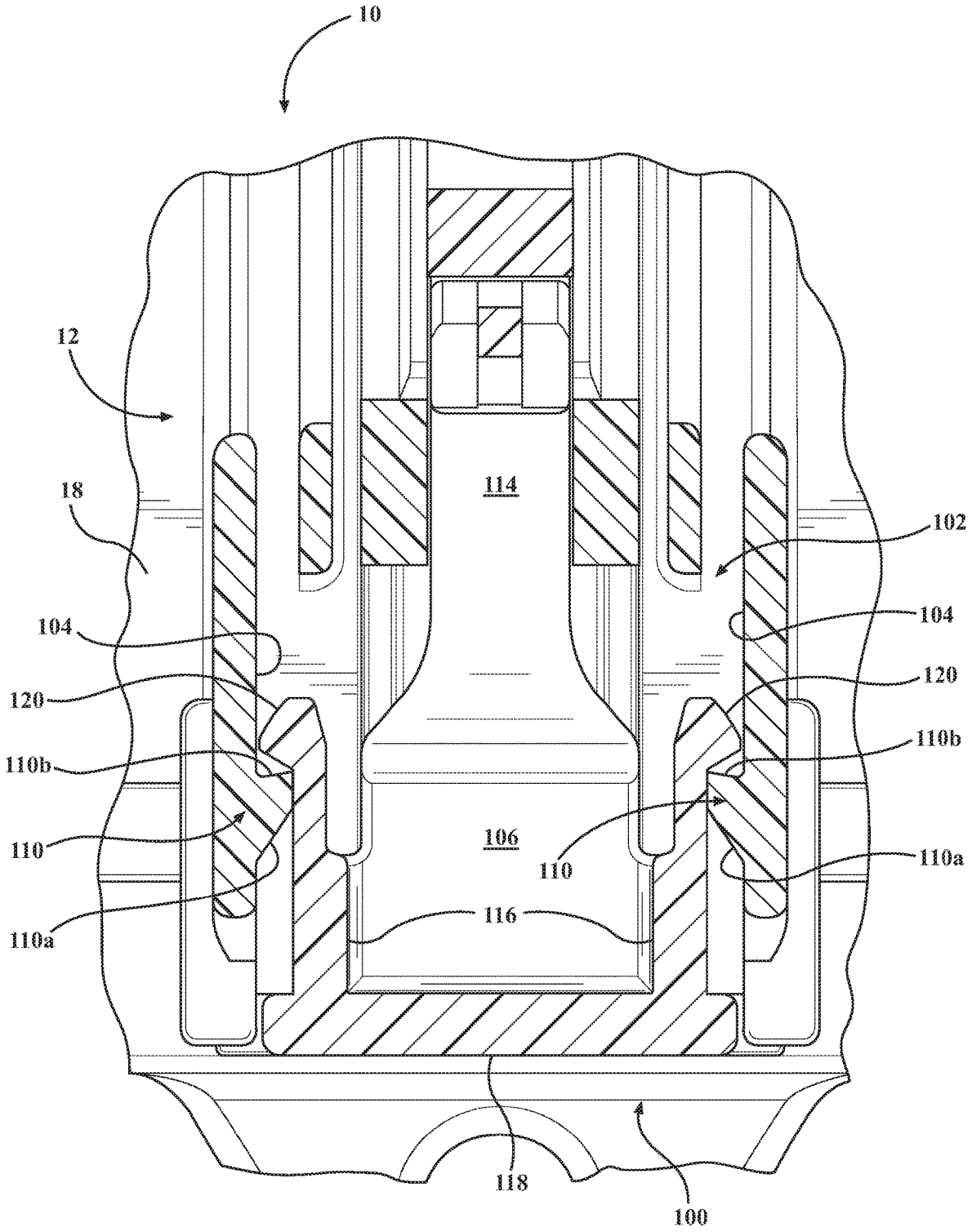
FIG. 6 is a top down cross-sectional view of the connector positioning assurance member engaged with the connector positioning housing in a pre-stage position.
Figure 7:
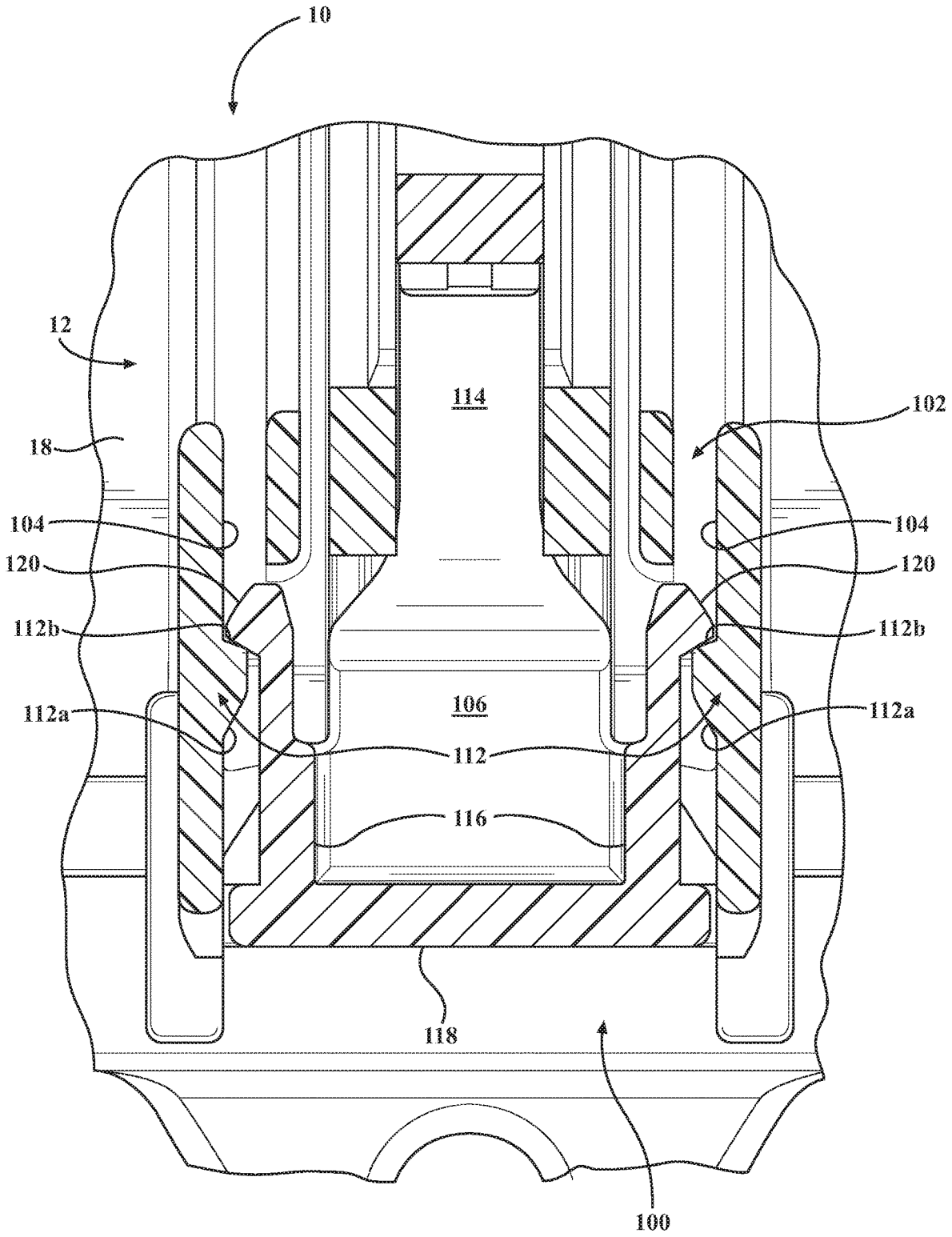
FIG. 7 is a top down cross-sectional view of the connector positioning assurance member engaged with the connector positioning housing in a locking position.

With reference again to FIGS. 3 and 5 and now to FIGS. 6 and 7 an aspect of the connector housing assembly 10 is provided wherein the connector housing assembly 10 is configured to help prevent the connector positioning assurance member 100 from being inadvertently moved from a pre-stage position to a locking position. The connector housing assembly 10 includes a connector positioning housing 102. The connector positioning housing 102 is disposed on the top wall 18 of the connector housing 12 and includes the support wall 84, a pair of third side walls 104 spaced apart from each other and extending generally orthogonal from opposing sides of the support wall 84.

The support wall 84 is a generally planar member disposed along a plane parallel to and beneath the plane defining the top wall 18 of the connector housing 12. A portion 84*a* of the support wall 84 extends beyond an outer surface 24*a* of the back end 24 of the connector housing 12. The remaining portion of the support wall 84 extends into the body of the connector housing 12.

The third side walls 104 and the support wall 84 define a third cavity 106. The third cavity 106 is configured to receive the connector positioning assurance member 100. A third top wall 108 includes a pair of side portions 108*a* spaced apart from each other so as to define a top opening 108*b*.

The inner surface of each of the third side walls 104 includes a first engagement feature 110 and a second engagement feature 112. The first and second engagement features 110, 112 are illustratively shown as ramp 110*a*, 112*a* having a catching end 110*b*, 112*b*. The first and second engagement features 110, 112 are axially aligned with each other along the width of the third cavity 106. The first engagement features 110 are closer to the back end 20 of the connector housing 12 relative to the second engagement features 112.

The connector positioning assurance member 100 includes an engagement tab 114 configured to engage mating feature (not shown) of a corresponding connector housing (not shown). The connector positioning assurance member 100 further includes a pair of fingers 116 disposed on opposite sides of a push feature 118. The push feature 118 is a generally planar member having an area configured to receive a finger or thumb. The pair of fingers 116 are generally orthogonal to the push feature 118. The fingers 116 are generally flexible and resilient members and include a second catch 120 disposed on the distal end of the finger 116. The second catch 120 is configured to engaged a respective catching end 110*b*, 112*b* of a corresponding first and second engagement features 110, 112.

With reference now to FIGS. 6 and 7, a top down cross-sectional view of the connector positioning assurance member 100 in the connector positioning housing 102 are provided. FIG. 6 depicts the connector positioning assurance member 100 in a pre-stage position. In the pre-stage position, the fingers 116 are engaged with the first engagement feature 110, wherein the second catch 120 of each finger 116 has slid over a ramp 110*a* of each third side wall 104 and the second catch 120 of each finger 116 is engaged with a corresponding catching end 110*b* of the third side walls 104. The fingers 116 have a length so as to position the push feature 118 to be aligned with the free end of the support wall 84. FIG. 5 also shows the connector positioning assurance member 100 in the pre-stage position, wherein the push feature 118 is aligned with the free end of the support wall 84. Accordingly, the push feature 118 is prevented from sliding further along the support wall 84 and into the locked position in instances where a load is applied to both the push feature 118 and the support wall 84.

FIG. 7 shows the connector positioning assurance member 100 in a locked position wherein the second catch 120 of each finger 116 has slid over a ramp 112*a* of each third side wall 104 and the second catch 120 of each finger 116 is engaged with a corresponding catching end 112*b* of the third side walls 104. FIG. 7 taken in consideration with FIG. 5 illustrates how movement of the connector positioning assurance member 100 requires an isolated load applied just to the push feature 118. Accordingly, the connector assembly 10 is further configured to help prevent the connector positioning assurance member 100 from being inadvertently pushed from the pre-stage position to the locked position.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector housing assembly configured to hold a cable and withstand a cantilevered force applied by the cable, the connector housing assembly comprising:

a connector housing having a pair of first side walls, a top wall, a bottom wall, and a cable cavity extending between a back end and a front end of the connector housing;

a dress cover configured to attach to the back end the connector housing, the dress cover having an attachment portion and a base, the attachment portion having a pair of second side walls configured to engage the back end of the connector housing;

an anti-rotational locking structure for withstanding the cantilevered force of the cable applied to the dress cover, the anti-rotational locking structure includes a first planar edge and a second planar edge, wherein the first planar edge is disposed above the second planar edge so as to withstand the cantilevered force applied by the cable by preventing the dress cover from rotating with respect to the connector housing; and a lateral confinement structure, the lateral confinement structure configured to overcome a load which may pull the dress cover away from the connector housing in a lateral direction, wherein the lateral confinement structure is disposed on the connector housing and the dress cover.

2. The connector housing assembly of claim 1, wherein the first planar edge is disposed on one of the pair of first side walls of the connector housing, and the second planar edge is disposed on one of the pair of second side walls of the dress cover, wherein the second planar edge is configured to slide underneath the first planar edge.

3. The connector housing assembly of claim 1, further including a rib disposed on an outer surface of one of the pair of first side walls of the connector housing, the rib defining the first planar edge, and wherein a top edge of one of the pair of second side walls defines the second planar edge.

4. The connector housing assembly of claim 3, wherein the rib is a pair of ribs, one of the pair of ribs is disposed on one of the pair of first side walls and the other of the pair of ribs is disposed on the other of the pair of first side walls, wherein the top edge of each of the pair of second side walls defines the second planar edge.

5. The connector housing assembly of claim 1, further including a groove and a leg, wherein the groove is formed on one of the pair of first side walls, and the leg is disposed on one of the pair of second side walls, wherein the groove defines the first planar edge opposite a first bottom edge, the leg defines the second planar edge opposite a second bottom edge, and the leg is configured to slide within the groove, wherein the second planar edge is slid against the first planar edge and the second bottom edge is slid against the first bottom edge.

6. The connector housing assembly of claim 5, wherein the dress cover includes a pair of grooves and a pair of legs, one of the pair of grooves is disposed on one of the pair of first side walls and the other of the pair of grooves is disposed on the other of the pair of first side walls, one of the pair of legs is disposed on one of the pair of second side walls and the other of the pair of legs is disposed on the other of the pair of second side walls.

7. The connector housing assembly of claim 1, further including a locking tab, a rib and a clip disposed on one of the pair of second side walls, the rib disposed on an outer surface of one of the pair of first side walls of the connector housing, the rib defining the first planar edge, the locking tab disposed beneath the rib, wherein the clip includes a slot configured to receive the locking tab, wherein a top portion of the clip defines the second planar edge.

8. The connector housing assembly of claim 7, wherein the locking tab is a pair of locking tabs, the rib is a pair of ribs and the clip is a pair of clips, wherein each of the pair of locking tabs is disposed on a respective one of the pair of first side walls, each of the pair of ribs is disposed on a respective one of the pair of first side walls, and wherein each of the pair of clips is disposed on a respective one of the pair of second side walls.

9. The connector housing assembly of claim 1, further including a guide feature configured to guide the dress cover onto the connector housing.

10. The connector housing assembly of claim 9, wherein the guide feature is a semi-annular lip surrounding a top portion of a hole disposed on a back wall of the attachment portion.

11. The connector housing assembly of claim 10, wherein the cable cavity is defined by a cylindrical member and a proximal end of the cylindrical member extends beyond an outer surface of a back end of the connector housing.

12. The connector housing assembly of claim 11, wherein the connector housing further includes a support wall configured to support a connector positioning assurance member, the support wall spaced apart from the cylindrical member so as to form a gap sufficient to receive the semi-annular lip.

13. The connector housing assembly of claim 1, wherein the lateral confinement structure is disposed on the bottom wall of the connector housing and a seat portion of the dress cover.

14. The connector housing assembly of claim 13, wherein the lateral confinement structure includes an under groove disposed on the bottom wall of the connector housing and a bottom leg disposed on the seat portion of the attachment portion of the dress cover, wherein the bottom leg configured to slide along the under groove.

15. The connector housing assembly of claim 1, the connector housing including a plurality of first planar edges and the dress cover includes a plurality of second planar edges, a locking tab, a rib, and a clip disposed on one of the pair of second side walls, the rib disposed on an outer surface of one of the pair of first side walls of the connector housing, the rib defining one of the plurality of first planar edges, the locking tab disposed beneath the rib, wherein the clip includes a slot configured to receive the locking tab, wherein a top portion of the clip defines one of the plurality of second planar edges; and a groove and a leg, wherein the groove is formed on one of the pair of first side walls, and the leg is disposed on one of the pair of second side walls, wherein the groove defines one of the plurality of first planar edges opposite a first bottom edge, the leg defines one of the plurality of second planar edges opposite a second bottom edge, and the leg is configured to slide within the groove.

16. The connector housing assembly of claim 15, the base may further include a gripper disposed on a back surface of the base, the gripper configured to hold the cable.

17. The connector housing assembly of claim 15, wherein gripper includes a pair of resilient arms spaced apart from each other.

18. A connector assembly comprising:

a connector housing having top wall, a bottom wall, a pair of first side walls, a back end and a front end, the connector housing further including a connector positioning housing disposed on the top wall, the connector positioning housing having a support wall and a pair of third side walls, the pair of third side walls are spaced apart from each other and extend orthogonally from opposing sides of the support wall, each of the pair of third side walls having an inner surface defining a third cavity and each of the pair of third side walls having a first engagement feature and a second engagement feature, the first engagement feature disposed closer to the back end of the connector housing relative to the second engagement feature, wherein a portion of the support wall extends beyond an outer surface of the back end of the connector housing; and a connector positioning assurance member configured to be seated on the support wall, the connector positioning assurance member having a push feature and a pair of fingers and an engagement tab, each of the pair of fingers are orthogonal to the push feature and configured to engage a respective first engagement feature and second engagement feature, wherein when the pair of fingers are engaged with the first engagement feature, the pair of fingers position the push feature so as to be aligned with a free end of the support wall, the engagement tab disposed between the pair of fingers and having a ramp shaped member disposed on a distal end of the engagement tab.

19. The connector assembly as set forth in claim 18, wherein the first engagement feature and the second engagement feature each include a ramp and a catch end.

20. The connector assembly as set forth in claim 19, wherein each of the pair of fingers is a generally flexible and resilient member and includes a second catch disposed on a distal end, the second catch configured to engage the catch end of a respective first or second engagement feature.

* * * * *